United States Patent [19]

Wade

[11] 3,943,727

[45] Mar. 16, 1976

[54] PORTABLE ELECTRIC WATER COOLER SUITABLE FOR OUTDOOR USE

[76] Inventor: George C. Wade, Box 10801, Jackson, Miss. 39209

[22] Filed: Apr. 10, 1974

[21] Appl. No.: 459,778

[52] U.S. Cl. ..... 62/395; 62/396; 137/565; 165/30

[51] Int. Cl.[2] ..... B67D 5/62

[58] Field of Search ..... 165/30; 62/201, 394, 395, 62/396, 397, 389; 137/565; 222/75; 251/352

[56] References Cited

UNITED STATES PATENTS

| | | | |
|---|---|---|---|
| 1,586,745 | 6/1926 | Hulse | 62/395 X |
| 1,914,736 | 6/1933 | Coutu | 251/335 |
| 2,171,740 | 9/1939 | Brown | 165/30 X |
| 2,560,488 | 7/1951 | Smith | 165/30 |
| 2,804,993 | 9/1957 | Davis et al. | 222/75 |
| 3,094,164 | 6/1963 | Sherman et al. | 165/30 |
| 3,323,578 | 6/1967 | Hermann | 165/30 |
| 3,333,438 | 8/1967 | Benua et al. | 62/395 |
| 3,648,477 | 3/1972 | Shartle | 62/394 |

*Primary Examiner*—Charles J. Myhre
*Assistant Examiner*—Daniel J. O'Connor

[57] ABSTRACT

A portable electrically refrigerated water cooler is adapted for year-round outdoor use by means of a thermostatically controlled heating cable wrapped about the water-containing components, and a similarly controlled heating element immersed in the water reservoir. A combined faucet-switch unit permits cool water to be pumped through the faucet for immediate use and prevents contaminants from entering the water when the switch is off.

4 Claims, 3 Drawing Figures

PORTABLE ELECTRIC WATER COOLER SUITABLE FOR OUTDOOR USE

BACKGROUND OF THE INVENTION

The present invention relates to portable electric water coolers, and more particularly to such water coolers as may be utilized outdoors without danger of damage from freezing or water contamination.

Prior art water coolers are severely limited in their utilization by two considerations. The first consideration relates to ambient temperature; that is, prior art water coolers cannot be utilized in sub-freezing temperatures because the water would freeze and damage the unit. The second consideration relates to contamination of the water in the cooler. Specifically, it is desirable to utilize an electrically operated pump to force cool water from a spigot or faucet since doing so avoids the need for gravity feeding the output water and thereby requiring the water reservoir to be located above the output spigot. A typical prior art pump-operated water cooler is illustrated in U.S. Pat. No. 3,333,438 to Benua et al. In that patent an arrangement is provided whereby the water pump is operated by a switch mechanism located adjacent the output water faucet. The system is efficient for purposes of delivering output water but leaves the stored cool water and its output line in direct communication with ambient air when water is not being delivered from the cooler. This permits contaminants in the air to enter the output line and contaminate the water. In addition, larger particles in the ambient environment, such as might be present at a construction sight, can enter the output line and block water outflow.

It is therefore an object of the present invention to provide a portable water cooler which is suitable for use in sub-freezing environments.

It is another object of the present invention to provide a portable water cooler which prevents contaminants from entering the water system via the dispensing nozzle when water is not being delivered from the nozzle.

SUMMARY OF THE INVENTION

In accordance with one aspect of the present invention an electrically operated portable water cooler employs a thermostatically controlled electric heating circuit which includes a heating cable wrapped around the condenser, compressor, and cool water tank. In addition the thermostatically controlled circuit includes a heating element which is immersed in the water reservoir. The thermostat is set to actuate the heating circuit, including both the heating cable and the heating element, when the ambient temperature falls below the freezing temperature of water.

In accordance with another aspect of the present invention, the portable water cooler utilizes a combined faucet valve and switch unit which in the off position blocks communication between the cool water outflow line and the ambient environment. In its on position the switch actuates a pump which forces cool water through the faucet valve.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein.

DESCRIPTION OF THE PREFERRED EMBODIMENT

Figure 1:
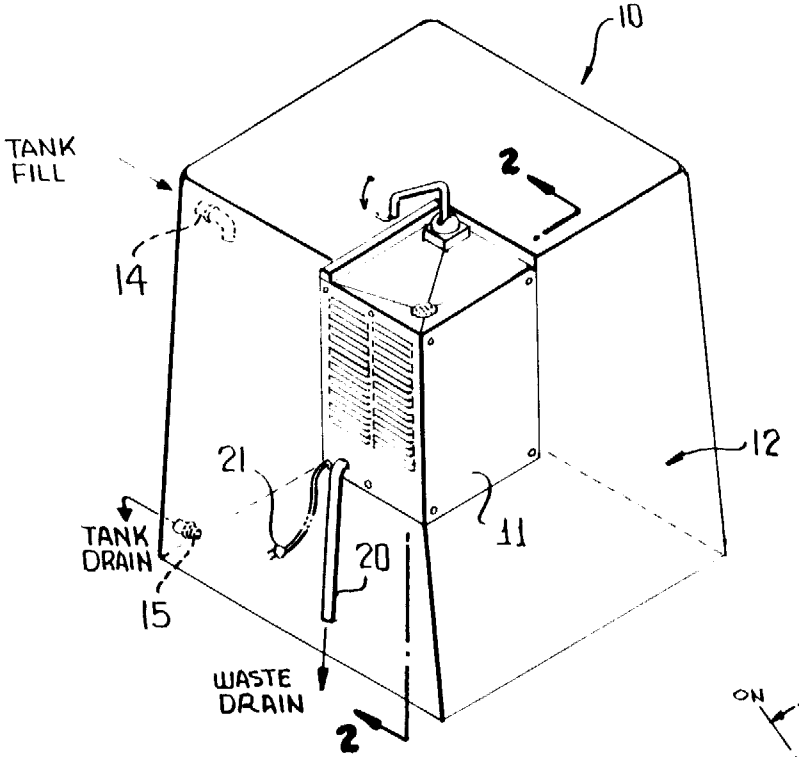
FIG. 1 is a view in perspective of a portable water cooler assembly according to the present invention.

Referring specifically to FIG. 1 of the accompanying drawings there is illustrated a portable water cooler assembly 10 of generally trapezohedron configuration. A cooling unit 11 is located in the upper portion of one corner of the assembly. The remainder of the assembly is utilized as a water reservoir 12. The reservoir walls are preferably made of Fiberglas or other similar light weight but strong material. In addition the reservoir walls are preferably insulated to minimize the effect of ambient temperature on the stored water.

A fitting 14, suitable for connection to a standard water supply plumbing line, is located proximate the top of the reservoir 12 and permits ingress of water for purposes of filling the reservoir. A controllable drain valve 15 is located proximate the bottom of the reservoir to permit the reservoir to be emptied when necessary.

The top of cooling unit 11 includes a faucet valve-switch assembly 17 from which cool water egresses when the assembly 17 is rotated downward in the manner illustrated by the arrow in FIG. 1. The upper surface of cooling assembly 11 is sloped toward a drain opening 18 which communicates with waste drain pipe 20. The latter is arranged to conduct waste outflow to a suitable drainage or sewage location. A standard ground-type primary power plug 21 is arranged to mate with a suitable 115 volt, 60 Hz power source receptacle for the purpose of supplying primary power to the cooling unit 11.

Figure 2:
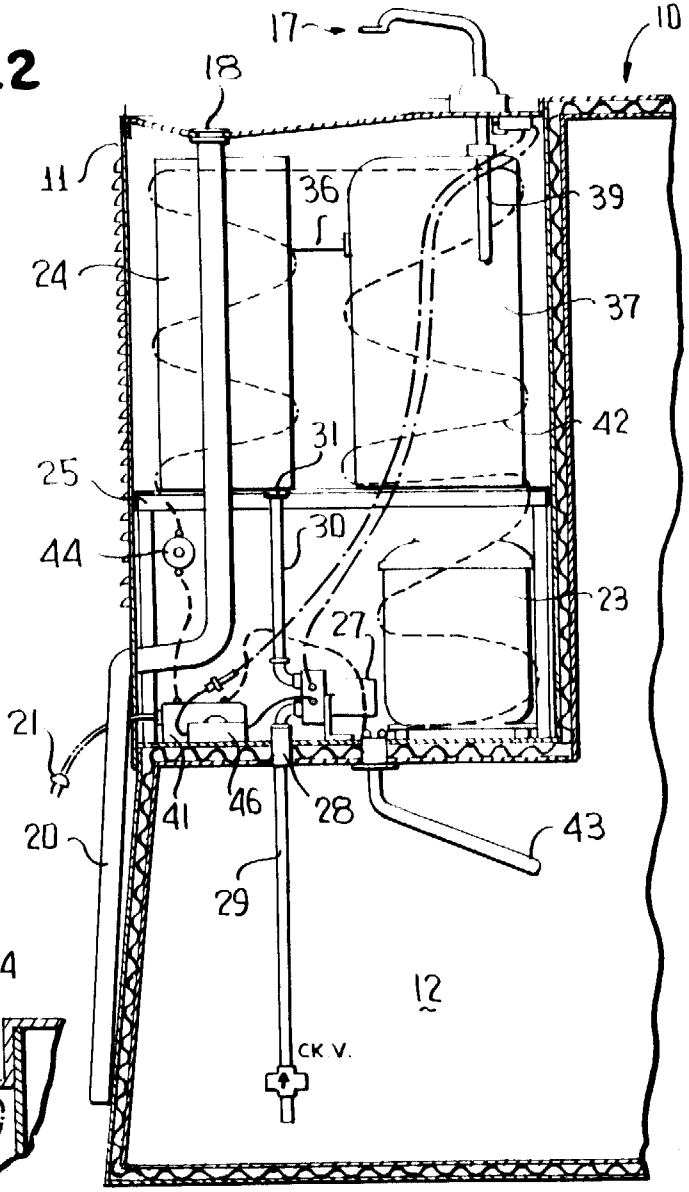
FIG. 2 is a plan view in section taken along lines 2—2 of FIG. 1.

Cooling assembly 11 is illustrated in detail in FIG. 2 of the accompanying drawings. The cooling components per se are conventional in type and in operation. These components include compressor 23, mounted in the lower portion of cooling assembly 11, and condenser unit 24 mounted in the upper portion of the cooling assembly on support shelf 25. Compressor 23 is of the usual type and its operation is controlled in a conventional manner such that it cooperates with condenser unit 24 to cool water being passed through the condenser unit.

A water pump 27 is mounted on the bottom wall of cooling assembly 11 and has its water inlet passage connected to water filter 28. Filter 28 in turn is connected to supply pipe 29 which extends through the cooling assembly wall into reservoir 12 to supply reservoir water to pump 27 on demand. The output line from pump 27 is connected by pipe 30 to the inlet water connection for condenser unit 24.

A connecting pipe 36 connects between condenser unit 24 and a cool water tank 37 and thereby serves as an outflow passage for water passed through the condenser unit. An outflow passage 39 extends from within cool water tank 37 into communication with the faucet valve-switch assembly 17. Water pumped through the system by pump 27 is thus caused to pass through pipe 30, condenser unit 24, passage 36 and cool water tank 37 where it egresses through pipe 39 and the faucet valve-switch assembly 17.

Primary power received through power plug 21 is connected to the primary power junction box 41. A heating circuit, operated at 115 volts, 60 Hz, includes a heating cable 42 which is wrapped around the compressor 23, condenser unit 24 and cool water tank 37. Heating cable 42 is connected in series with a heating element 43 which extends through the bottom wall of cooling assembly 11 into reservoir 12. Heating element 43 is typically a 1500 watt heating element, although the power rating of the heating element is selected by the volume of water which can be stored in reservoir 12. Also part of the heating circuit is a thermostat 44 which is connected in series with both the heating cable 42 and heating element 43. Thermostat 44 serves as a temperature actuated switch which normally prevents current flow through the heating circuit unless the temperature falls below the freezing temperature for water (nominally 32°F.). When the temperature does fall below freezing, the thermostat permits current to flow from the 115 volt source through heating element 43 and heating cable 42 to prevent water in the assembly from freezing.

A 12 volt connector box 46 receives primary 115 volt, 60 Hz power from junction box 41 and converts it into 12 volts dc. This 12 volt dc supply is utilized to operate water pump 27 in response to actuation of the faucet valve-switch assembly 17. Specifically, water pump 27 and the switch portion of unit 17 are connected in series across the 12 volt supply. When the switch portion of faucet valve-switch unit 17 is actuated, pump 27 is energized and forces water from reservoir 12 through the condenser unit 24, cool water tank 37 and outlet pipe 39 from which the water is delivered to the faucet valve-switch unit.

Figure 3:
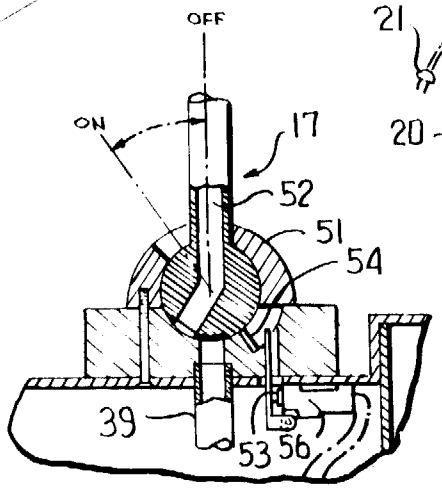
FIG. 3 is a detailed view in section of the faucet valve-switch unit employed in the water cooler of FIGS. 1 and 2.

The faucet valve-switch unit 17 is illustrated in detail in FIG. 3. The valve portion is illustrated as a conventional ball-in-socket valve having two positions. In the off position, illustrated in FIG. 3, a fluid passage 52, which extends through ball 51, has its inlet end blocked and out of communication with outflow passage 39 from the cool water tank 37. As a consequence contaminants in the ambient environment are blocked from entering pipe 39 and the cool water tank.

A cam member 54 projects radially from ball member 51 toward an actuating arm 53 of microswitch unit 56. When the ball 51 is in its off position, cam member 54 is out of communication with switch arm 53 so that the switch is not actuated and pump 27 is not energized.

If the faucet valve-switch assembly 17 is placed in its on position, as by rotating the assembly downward in the manner illustrated by arrows in FIGS. 1 and 3, passage 52 through ball member 51 is brought into communication with output pipe 39 from the cool water tank 37. In addition, cam member 54 is urged against switch arm 53 to actuate microswitch 56. Actuation of microswitch 56 energizes pump 27 to force cool water out through the faucet valve-switch assembly 17.

The portable water cooler assembly described hereinabove is capable of substantial modification without departing from the spirit and scope of the present invention. Even the specific embodiment of faucet valve-switch assembly 17 may be varied as long as the faucet itself serves as the switch actuator and the outflow tube 39 is blocked when the switch is off. Likewise, the particular location and arrangement of the heating cable 42 and heating element 43 can be varied within the limitation that the cable and heating element shall serve the function of preventing water in assembly 10 from freezing.

Although not specifically illustrated in the drawings, the faucet member of the faucet valve-switch assembly 17 may be biased to return to its OFF position whenever the actuating force is removed therefrom.

While I have described and illustrated one specific embodiment of my invention, it will be clear that variations of the details of construction which are specifically illustrated and described may be resorted to without departing from the true spirit and scope of the invention as defined in the appended claims.

I claim:

1. A portable refrigerated water cooler comprising:

a reservoir for storing water to be refrigerated;

refrigeration means for cooling water passed therethrough;

an electrically-actuable pump having an inlet connected to draw water from said reservoir and an outlet connected to deliver water through said refrigeration means;

means for supplying electrical power to said water cooler;

a combined faucet valve-switch unit for delivering cool water from said refrigeration means, said unit including: a faucet member having first and second positions and containing a flow path which in said first position provides flow communication for water from said refrigeration means to externally of said water cooler and in said second position is blocked from providing said flow communication; and an electrical switch arranged to be actuated by said faucet member in said first position, said switch being connected in circuit with said pump to apply electrical power to actuate said pump when said switch is actuated;

an electrical heating cable wrapped about the outer surface of and in direct contact with said reservoir and said refrigeration means;

an electrical heating element disposed in said reservoir; and thermostatically-operated switch means connected in series with said cable and said heating element and arranged to pass current from said electrical power supply means through said cable and element when the ambient temperature in said water cooler falls below freezing.

2. The portable refrigerated water cooler according to claim 1 wherein said faucet valve-switch unit comprises:

a ball-in-socket valve comprising a ball member rotatably secured in a socket having an elongated aperture, said ball member including a stem projecting through said aperture such that movement of said ball member is restricted between two extreme positions defined by the ends of said elongated aperture, said two extreme positions corresponding to said first and second positions of said faucet member, said ball and stem having an outlet flow passage defined therethrough, said socket having an inlet flow passage defined therethrough and communicating with said refrigeration means to conduct water from said refrigeration means when said pump is actuated, said inlet flow passage being positioned such that it is aligned with said outlet flow passage when said faucet member is in said first position and is out of communication with said outlet flow passage when said faucet member is in said second position;

a microswitch having an actuable switch arm; and a cam projecting from said ball member and positioned to actuate said switch arm in said first position of said faucet member and to be remote from said switch arm in said second position of said faucet member.

3. A refrigerated water cooler characterized in that it is adapted for outdoor use in sub-freezing temperatures, said water cooler comprising:

a reservoir for storing water to be refrigerated;

refrigeration means for cooling water passed therethrough from said reservoir;

an outlet spigot connected to receive cooled water passed through said refrigeration means and conduct said cool water externally of said water cooler;

actuable means for selectively delivering water from said reservoir through said refrigeration means to said outlet spigot; and thermostatically-controlled electrical heating means disposed in said water cooler for automatically maintaining the temperature in said water cooler above the freezing temperature of water;

wherein said heating means comprises an electrical heating cable wrapped about the outer surface of and in direct contact with said reservoir and said refrigeration means.

4. A refrigerated water cooler characterized in that it is adapted for outdoor use in sub-freezing temperatures, said water cooler comprising:

a reservoir for storing water to be refrigerated;

refrigeration means for cooling water passed therethrough from said reservoir;

an outlet spigot connected to receive cooled water passed through said refrigeration means and conduct said cool water externally of said water cooler;

actuable means for selectively delivering water from said reservoir through said refrigeration means to said outlet spigot; and thermostatically-controlled electrical heating means disposed in said water cooler for automatically maintaining the temperature in said water cooler above the freezing temperature of water;

wherein said electrical heating means includes:

a pair of electrical terminals adapted to be connected to a source of voltage;

an electrical heating cable wrapped around the outer surface of and in direct contact with said reservoir and said refrigeration means;

an electrical heating element disposed in said reservoir;

a thermostat switch; and circuit means connecting said cable, element and thermostat switch in series between said pair of terminals.

* * * * *